US011624360B2

(12) United States Patent
Goy et al.

(10) Patent No.: US 11,624,360 B2
(45) Date of Patent: Apr. 11, 2023

(54) GEAR PUMP WITH GEAR INCLUDING ETCHED SURFACES

(71) Applicant: Hamilton Sundstrand Corporation, Charlotte, NC (US)

(72) Inventors: Edward W. Goy, Crystal Lake, IL (US); Weishun William Ni, Rockton, IL (US); John M. Kassel, Roscoe, IL (US)

(73) Assignee: HAMILTON SUNDSTRAND CORPORATION, Charlotte, NC (US)

( * ) Notice: Subject to any disclaimer, the term of this patent is extended or adjusted under 35 U.S.C. 154(b) by 65 days.

(21) Appl. No.: 17/132,534

(22) Filed: Dec. 23, 2020

(65) Prior Publication Data

US 2022/0196013 A1 Jun. 23, 2022

(51) Int. Cl.
*F04C 2/08* (2006.01)
*F04C 2/18* (2006.01)

(52) U.S. Cl.
CPC ..... *F04C 2/084* (2013.01); *F04C 2210/1044* (2013.01); *F04C 2240/30* (2013.01); *F04C 2240/50* (2013.01)

(58) Field of Classification Search
CPC .... F04C 2/084; F04C 2/18; F04C 2/16; F04C 18/084; F04C 18/16; F04C 2210/1044; F04C 2240/20; F04C 2240/30; F04C 2240/50; F04C 2250/20
See application file for complete search history.

(56) References Cited

U.S. PATENT DOCUMENTS

| | | | | |
|---|---|---|---|---|
| 4,728,201 | A | 3/1988 | Abbe | |
| 5,164,957 | A | 11/1992 | Nakagawa et al. | |
| 6,939,093 | B2 * | 9/2005 | Arvin | B23F 21/16 409/12 |
| 7,086,324 | B2 | 8/2006 | Buettner et al. | |
| 8,402,659 | B2 * | 3/2013 | Kotthoff | F16H 55/06 29/893.3 |
| 8,512,018 | B2 | 8/2013 | Jordan et al. | |

(Continued)

FOREIGN PATENT DOCUMENTS

| | | | |
|---|---|---|---|
| GB | 574364 | A | 1/1946 |
| JP | 51109401 | U | 9/1976 |

(Continued)

OTHER PUBLICATIONS

Extended European Search Report for European Application No. 21206565.0; dated May 10, 2022 (pp. 1-6).

*Primary Examiner* — Audrey B. Walter
*Assistant Examiner* — Dapinder Singh
(74) *Attorney, Agent, or Firm* — Cantor Colburn LLP

(57) ABSTRACT

A gear for a pump includes a gear body defining a root circle, and a plurality of gear teeth extending from the gear body radially outwardly of the root circle. Each of the plurality of gear teeth have a tip portion, a leading edge, a trailing edge, a circular thickness defined between the leading edge and the trailing edge, a first radially outwardly facing surface and a second radially outwardly facing surface. At least one of the first radially outwardly facing surface and the second radially outwardly facing surface includes a chamfered portion that extends from the leading edge toward the trailing edge across a portion of the circular thickness.

14 Claims, 5 Drawing Sheets

(56) References Cited

U.S. PATENT DOCUMENTS

| | | | | |
|---|---|---|---|---|
| 8,636,486 | B2 * | 1/2014 | Colombo | F04C 2/084 418/163 |
| 9,890,781 | B2 * | 2/2018 | Schmid | F04C 2/084 |
| 10,323,636 | B2 | 6/2019 | Craig et al. | |
| 2003/0183479 | A1 * | 10/2003 | Rau | F16D 23/04 192/108 |
| 2004/0010914 | A1 | 1/2004 | Saysette-Rasmussen et al. | |
| 2010/0178190 | A1 * | 7/2010 | Colombo | F04C 2/084 418/161 |
| 2014/0322060 | A1 | 10/2014 | Takeda | |
| 2016/0032922 | A1 * | 2/2016 | Kovach | F16C 32/0651 418/206.7 |
| 2020/0088285 | A1 * | 3/2020 | Vacca | F04C 2/084 |

FOREIGN PATENT DOCUMENTS

| | | | |
|---|---|---|---|
| RU | 94028903 | A | 5/1996 |
| WO | 2017143340 | A1 | 8/2017 |

* cited by examiner

GEAR PUMP WITH GEAR INCLUDING ETCHED SURFACES

BACKGROUND

Exemplary embodiments pertain to the art of gear pumps, more specifically to a gear pump having etched gear surfaces.

Many pumps, including those used to provide a motive force to fuel, employ rotating gears. These gears are supported by bearings that promote rotation. As the gears rotate, gear teeth mesh. The meshing of the gear teeth leads to an inter-tooth decreasing volume causing flow and downstream restrictions that generate pressure in a fluid. The fluid is passed through a conduit and, in the case of fuel, often times to an engine. In fuel applications, the bearings are often formed from leaded bronze. Leaded bronze can withstand prolonged exposure to fuel and possesses a conformability and thermal conductivity that resists galling and friction welding.

Surface properties of leaded bronze bearings have a limited PV value which is determined by multiplying a specific bearing load, or pressure (p), by sliding speed (v). The fuel, in addition to being passed through the pump, acts primarily as a coolant and a lubricant for pump components. As fuel gets hot, its viscosity drops; as fuel get cold, its viscosity increases. There is a general decrease in viscosity at higher temperatures, which results in a reduction in lubricating film thickness. The reduction in lubricating film thickness can lead to increased wear. Also, vapor filled cavities on gear tooth surfaces reduce surface contact with pump components which in turn lowers the lubrication benefit of fuel. Thus, fuel pumps that employ leaded bronze bearings have operational pressure, temperature, and speed limits. Accordingly, industry would more than welcome a fuel pump having components that resist galling and friction welding, while also being able to operate at higher temperatures and pressure ranges without loss of lubrication.

BRIEF DESCRIPTION

Disclosed is a gear for a pump including a gear body defining a root circle, and a plurality of gear teeth extending from the gear body radially outwardly of the root circle. Each of the plurality of gear teeth have a tip portion, a leading edge, a trailing edge, a circular thickness defined between the leading edge and the trailing edge, a first radially outwardly facing surface and a second radially outwardly facing surface. At least one of the first radially outwardly facing surface and the second radially outwardly facing surface includes a chamfered portion that extends from the leading edge toward the trailing edge across a portion of the circular thickness.

Also disclosed is a fuel pump including a housing having an interior, an inlet, and an outlet. A stationary bearing is mounted in the interior. A pressure loaded bearing is positioned in the interior opposite the stationary bearing. A gear is rotatably supported between the pressure loaded bearing and the stationary bearing. The gear includes a gear body having a root circle, and a plurality of gear teeth extending from the gear body radially outwardly of the root circle. Each of the plurality of gear teeth have a tip portion, a leading edge, a trailing edge, a circular thickness defined between the leading edge and the trailing edge, a first radially outwardly facing surface and a second radially outwardly facing surface. At least one of the first radially outwardly facing surface and the second radially outwardly facing surface includes a chamfered portion that extends from the leading edge toward the trailing edge across a portion of the circular thickness.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
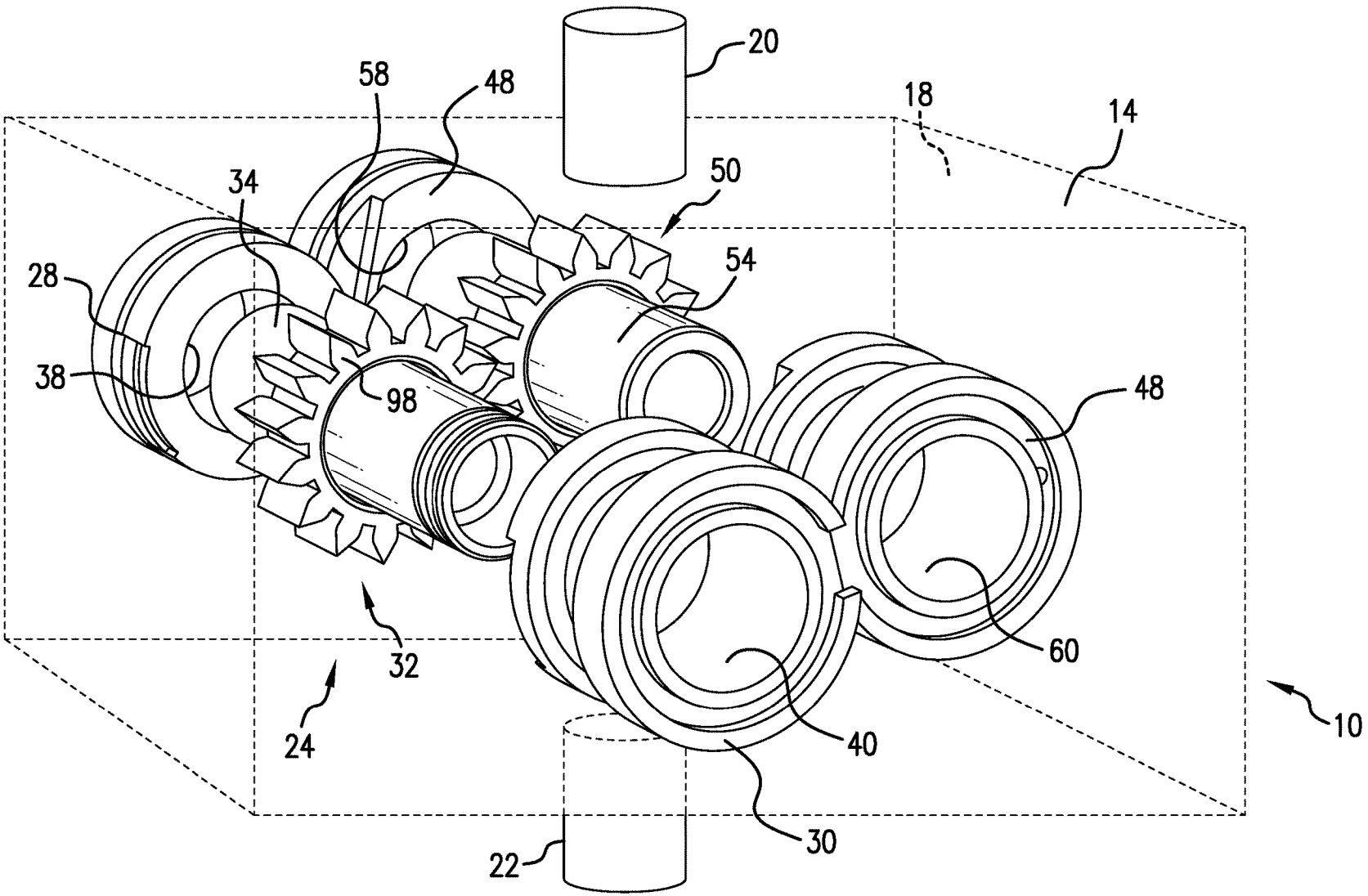
FIG. 1 depicts a gear pump including gear teeth having a chamfered portion, in accordance with an exemplary embodiment.

A fuel pump, in accordance with an exemplary aspect, is indicated generally at 10 in FIG. 1. Fuel pump 10 includes a housing 14 having an interior 18. Housing 14 includes an inlet 20 that leads fluid, such as fuel, into interior 18 and an outlet 22 that may direct the fluid from housing 14. A gear system 24 is disposed in interior 18. Gear system 24 is selectively activated in order to create a force that motivates the fluid from inlet 20 through outlet 22.

In an embodiment, gear system 24 includes a drive pressure loaded bearing or bushing 28 mounted in housing 14. A drive stationary bearing or bushing 30 is arranged axially opposite drive pressure loaded bearing 28. A drive gear 32 is mounted to a drive shaft 34 that is rotatably supported between drive pressure loaded bearing 28 and drive stationary bearing 30. That is, drive pressure loaded bearing 28 includes an opening 38 that receives a first end (not separately labeled) of drive shaft 34 and drive stationary bearing 30 includes an opening 40 that receives a second end (also not separately labeled) of drive shaft 34. Drive shaft 34 is connected to a motive source, such as a motor (not shown), and driven to rotate drive gear 32. In an embodiment, drive pressure loaded bearing 28 and drive stationary bearing 30 are formed from a material such as leaded bronze. However, it should be understood that other materials, such as aluminum, other bronze variants, or other materials that are compatible with the fluid and PV's may also be used.

Gear system 24 also includes a driven pressure loaded bearing or bushing 46 mounted in housing 14. A driven stationary bearing or bushing 48 is arranged axially opposite driven pressure loaded bearing 46. A driven gear 50 is mounted to a driven shaft 54 that is rotatably supported between driven pressure loaded bearing 46 and driven stationary bearing 48. That is, driven pressure loaded bearing 46 includes an opening portion 58 that receives a first end portion (not separately labeled) of driven shaft 54 and driven stationary bearing 48 includes an opening portion 60 that receives a second end portion (also not separately labeled) of driven shaft 54. Driven shaft 54 is rotated through an interaction between drive gear 32 and driven gear 50. In an embodiment, driven pressure loaded bearing 46 and driven stationary bearing 48 are formed from a material such as leaded bronze. However, it should be understood that other materials, such as aluminum, other bronze variants, or other materials that are compatible with the fluid and PV's may also be used.

Figure 2:
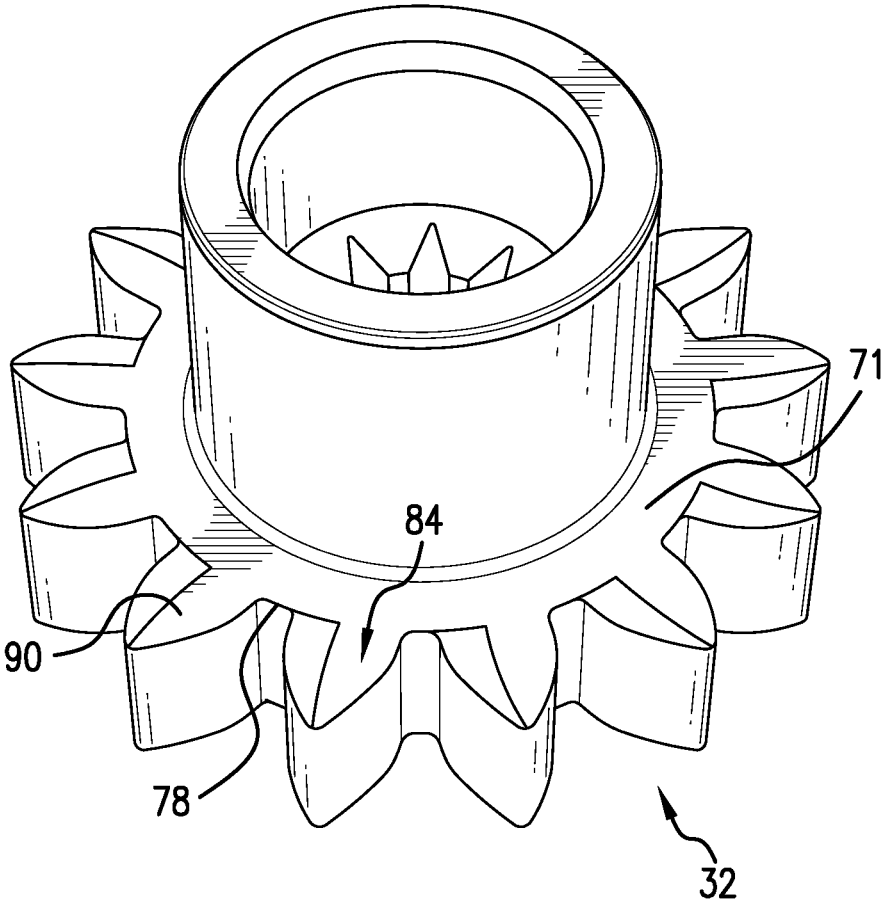
FIG. 2 depicts a perspective view of a gear from the gear pump of FIG. 1, in accordance with an exemplary aspect.
Figure 3:
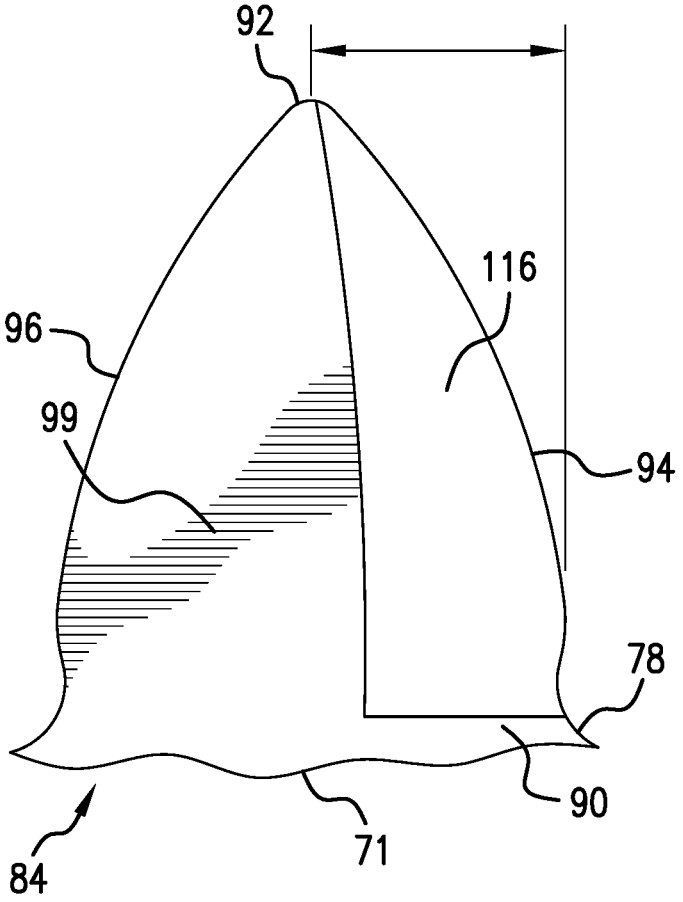
FIG. 3 depicts a plane view showing a chamfered portion of a gear tooth of the gear from FIG. 2.

Referring to FIG. 2, drive gear 32 includes a gear body 71 that may be press-fit onto drive shaft 34 or machined from a common barstock. Of course, drive gear 32 could also be mounted to drive shaft 34 through a key or through a brazed connection. Gear body 71 includes a root circle 73 from which radially outwardly project a plurality of gear teeth, one of which is indicated at 84. As shown in FIG. 3, each gear tooth 84 includes a base portion 90 positioned at root circle 78, a tip portion 92, a leading edge 94, and a trailing edge 96. Each gear tooth 84 also includes a first radially outwardly facing surface 99 and a second, opposing, radially outwardly facing surface (not shown). A circular thickness 108 is defined between leading edge 94 and trailing edge 96. Typically, the gears are a steel, but could be made from any number of other materials.

Figure 4:
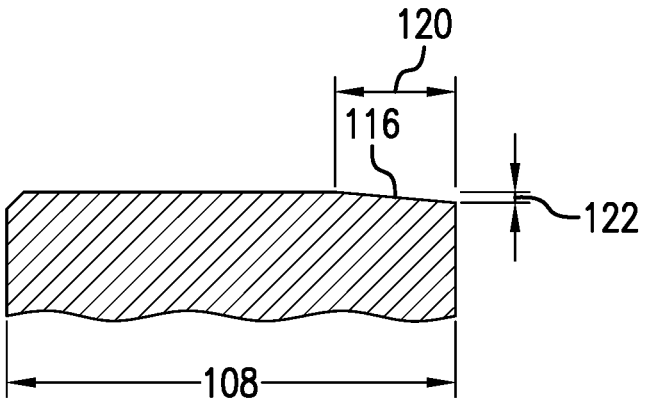
FIG. 4 is a partial end view of the gear tooth of FIG. 3 showing a roll off width and a height of the chamfered portion.

In an exemplary embodiment shown in FIG. 4, gear tooth 84 includes a chamfered portion 116 that extends from leading edge 94 toward trailing edge 96 across a portion of circular thickness 108. In an embodiment, chamfered portion 116 extends across about 43% of the circular thickness 108 so as to define a roll off width 120. In another embodiment, chamfered portion 116 extends across about 40% of circular thickness 108. In yet other embodiments, chamfered portion 116 can range from about 15% to about 50% of the tooth circular thickness containing a chamfered portion. Chamfered portion 116 includes a height of between about 2 and about 4 light bands (between about 0.00058 mm and about 0.000116 mm). At this point, it should be understood that while shown on first radially outwardly facing surface 99 the second radially outwardly facing surface may also include a chamfered portion.

Chamfered portion 116 may include a surface flatness of about 2.54 microns. The particular size and shape of the chamfered portion may vary and may be tailored to a particular tooth shape. Chamfered portion 116 forms an edge break that enhances and retains a surface film of lubricant (fuel) that increases service life of the pump, allows for increased pressures and speeds as well as the use of non-traditional bearing and gear material couples. It should be appreciated that the chamfered portion improves fluid entrainment results in an increase in fluid film. The increase in fluid film can results in a film region that exceeds a boundary layer or mixed film layer into full hydrodynamic lubrication which improves the load carrying capability of the gear and bearing material couple, improves heat transfer, and reduces friction and heat generation. Chamfered portion 116 may be formed through various laser etching processes that ensure high repeatability and maintenance of tolerances.

Figure 5:
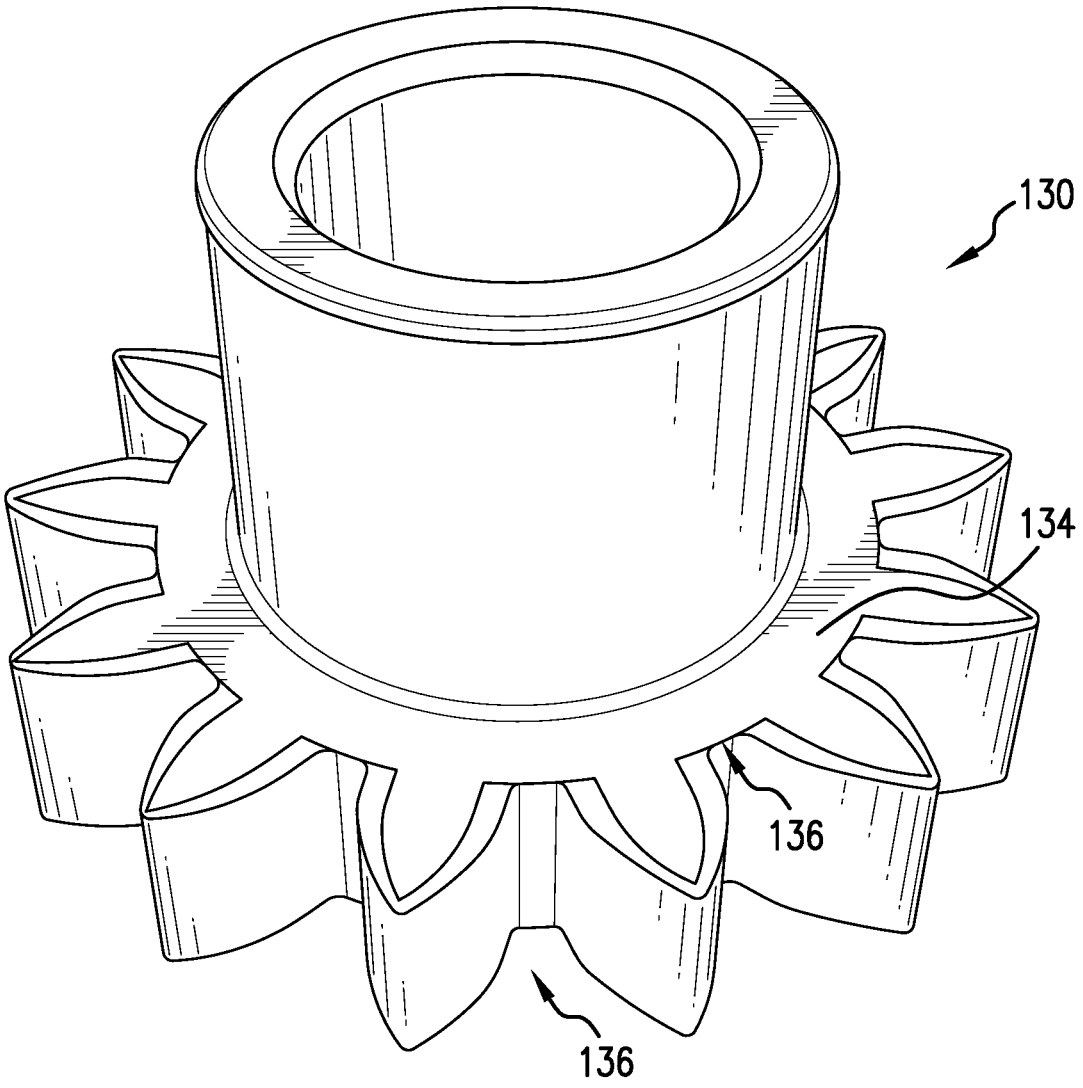
FIG. 5 depicts a perspective view of a gear from the gear pump, in accordance with another exemplary aspect.
Figure 6:
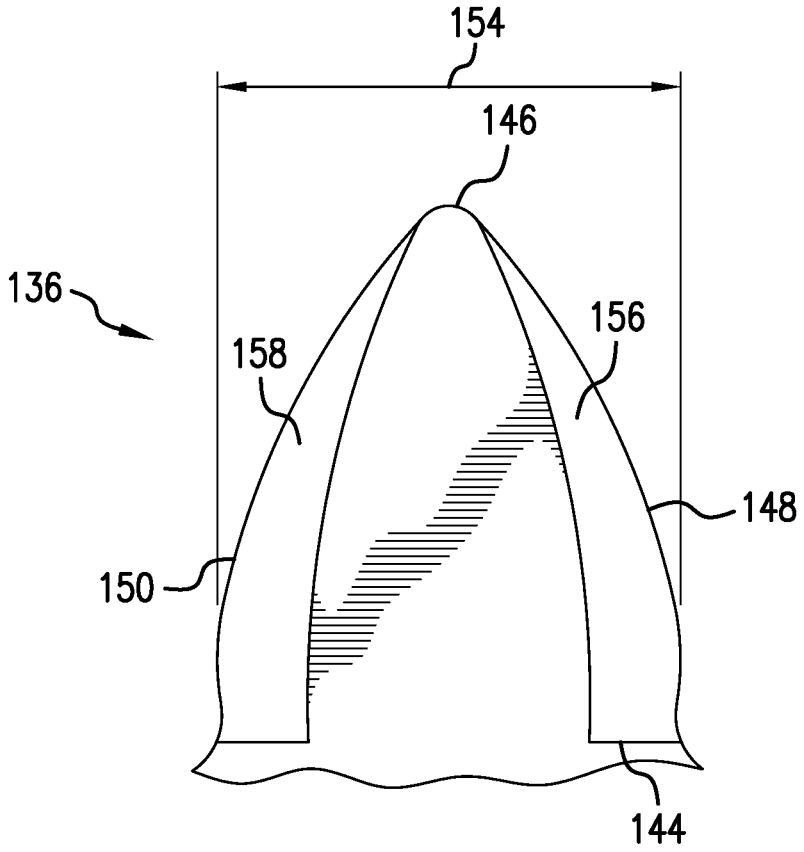
FIG. 6 depicts a plane view showing chamfered portions of a gear tooth of the gear from FIG. 5.

Reference will now follow to FIG. 5 in describing a gear 130 in accordance with another exemplary aspect. Gear 130 may take the form of a drive gear or a driven gear. In the embodiment shown, gear 130 includes a gear body 134 having a root circle 136. A plurality of gear teeth, one of which is indicated at 138, extends radially outwardly from root circle 136. As shown in FIG. 6, each gear tooth 138 includes a base portion 144 at root circle 136 and a tip portion 146. Each gear tooth 138 also includes a leading edge 148 and a trailing edge 150 between which is defined a circular thickness 154.

In an exemplary aspect, gear tooth 138 includes a first chamfered portion 158 that extends from leading edge 148 toward trailing edge 150 across about 15% of circular thickness 154. Gear tooth 138 also includes a second chamfered portion 160 that extends from trailing edge 150 toward leading edge 148 across about 15% of circular thickness 154. Each chamfered portion 158 and 160 includes a height of between about 2 and about 4 light bands (between about 0.00058 mm and about 0.000116 mm) and a surface flatness of about 1 micron. At this point, it should be understood that while shown on first radially outwardly facing surface 99 second radially outwardly facing surface 104 may also include a chamfered portion. By providing chamfered portions on both the leading and trailing edges of gear 130 may be used in either rotational direction.

Each chamfered portion 158, 160 forms an edge break, which depending upon a direction of rotation, enhances and retains a surface film of lubricant (fuel) that increases service life of the pump, allows for increased pressures and speeds as well as the use of non-traditional bearing and gear material couples. Chamfered portions 158 and 160 improve fluid entrainment that results in an increase in fluid film generated. The increase in the fluid film can bring the film region out of a boundary layer or mixed film layer into full hydrodynamic lubrication which improves the load carrying capability of the gear and bearing material couple, improves heat transfer, and reduces friction and heat generation.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. The term "about" is intended to include the degree of error associated with measurement of the particular quantity based upon the equipment available at the time of filing the application. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A gear for a pump comprising:

a gear body defining a root circle; and a plurality of gear teeth extending from the gear body radially outwardly of the root circle, each of the plurality of gear teeth having a tip portion, a leading edge, a trailing edge, a circular thickness defined between the leading edge and the trailing edge, and a radially outwardly facing surface, the radially outwardly facing surface including a chamfered portion that extends from only one of the leading edge and the trailing edge toward the other of the leading edge and the trailing edge across a portion of the circular thickness, wherein the chamfered portion extends from the root circle to the tip portion of each of the plurality of gear teeth.

2. The gear according to claim 1, wherein the portion comprises at least 15% of the circular thickness.

3. The gear according to claim 2, wherein the portion comprises at least 40% of the circular thickness.

4. The gear according to claim 3, wherein the portion comprises at least 43% of the circular thickness.

5. The gear according to claim 1, wherein the chamfered portion is formed on each radially outwardly facing surface of the plurality of gear teeth.

6. The gear according to claim 1, wherein the chamfered portion includes a height of at least about 2 light bands.

7. The gear according to claim 6, wherein the height of the chamfered portion is about 3 light bands.

8. A fuel pump comprising:

a housing including an interior, an inlet, and an outlet;

a stationary bearing mounted in the interior;

a pressure loaded bearing positioned in the interior opposite the stationary bearing; and a gear rotatably supported between the pressure loaded bearing and the stationary bearing, the gear comprising:

a gear body having a root circle; and a plurality of gear teeth extending from the gear body radially outwardly of the root circle, each of the plurality of gear teeth having a tip portion, a leading edge, a trailing edge, a circular thickness defined between the leading edge and the trailing edge, and a radially outwardly facing surface, the radially outwardly facing surface including a chamfered portion that extends from only one the leading edge and the trailing edge toward the other of the leading edge and the trailing edge across a portion of the circular thickness, wherein the chamfered portion extends from the root circle to the tip portion of each of the plurality of gear teeth.

9. The fuel pump according to claim 8, wherein the portion comprises about 15% of the circular thickness.

10. The fuel pump according to claim 9, wherein the portion comprises at least 40% of the circular thickness.

11. The fuel pump according to claim 10, wherein the portion comprises at least 43% of the circular thickness.

12. The fuel pump according to claim 8, wherein the chamfered portion is formed on each radially outwardly facing surface of the plurality of gear teeth.

13. The fuel pump according to claim 8, wherein the chamfered portion includes a height of at least about 2 light bands.

14. The fuel pump according to claim 13, wherein the height of the chamfered portion is about 3 light bands.

* * * * *